US006379498B1

(12) United States Patent
Burns et al.

(10) Patent No.: US 6,379,498 B1
(45) Date of Patent: Apr. 30, 2002

(54) METHOD FOR ADDING AN ADSORBABLE CHEMICAL ADDITIVE TO PULP DURING THE PULP PROCESSING AND PRODUCTS MADE BY SAID METHOD

(75) Inventors: Barbara Jean Burns; Louise Cynthia Ellis Coe, both of Appleton; Mike Thomas Goulet, Neenah; Michael John Rekoske, Appleton, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/514,740

(22) Filed: Feb. 28, 2000

(51) Int. Cl.[7] ..... D21H 23/00
(52) U.S. Cl. ..... 162/158; 162/180; 162/183
(58) Field of Search ..... 162/9, 10, 12, 162/100, 183, 182, 158

(56) References Cited

U.S. PATENT DOCUMENTS

| | | | | |
|---|---|---|---|---|
| 2,799,241 A | | 7/1957 | Wurster | |
| 3,089,824 A | | 5/1963 | Wurster | |
| 3,117,027 A | | 1/1964 | Lindlof et al. | |
| 3,196,827 A | | 7/1965 | Wurster et al. | |
| 3,207,824 A | | 9/1965 | Wurster et al. | |
| 3,241,520 A | | 3/1966 | Wurster et al. | |
| 3,253,944 A | | 5/1966 | Wurster | |
| 4,144,122 A | | 3/1979 | Emanuelsson et al. | |
| 4,432,833 A | | 2/1984 | Breese | |
| 4,481,077 A | * | 11/1984 | Herrick | 162/158 |
| 4,506,081 A | | 3/1985 | Fenyes et al. | |
| 4,508,860 A | * | 4/1985 | Hawes | 524/13 |
| 4,510,020 A | * | 4/1985 | Greenet al. | 162/169 |
| 4,623,588 A | | 11/1986 | Nuwayser et al. | |
| 4,675,140 A | | 6/1987 | Sparks et al. | |
| 4,720,383 A | | 1/1988 | Drach et al. | |
| 5,096,539 A | * | 3/1992 | Allan | 162/9 |

(List continued on next page.)

FOREIGN PATENT DOCUMENTS

| | | | | |
|---|---|---|---|---|
| EP | 0 116 512 A1 | | 8/1984 | |
| EP | 0 132 128 A1 | | 1/1985 | |
| WO | WO 97/31153 A1 | | 8/1997 | |
| WO | WO 98/17856 A1 | | 4/1998 | |
| WO | WO-9931312 | * | 6/1999 | D06M/15/263 |

OTHER PUBLICATIONS

*Pulp and Paper Manufacture: The Pulping of Wood*, Second Edition, vol. 1, pp. 33–72, Ronald G. MacDonald, editor.

*Primary Examiner*—Peter Chin
*Assistant Examiner*—Carlos Lopez
(74) *Attorney, Agent, or Firm*—Patricia A. Charlier

(57) ABSTRACT

Pulp fibers can be treated with adsorbable chemicals with a minimal amount of unadsorbed chemical additives present later in the papermaking process water. A method for adding an adsorbable chemical to pulp includes mixing pulp fibers that have never been dried with water to form a fiber slurry. An adsorbable chemical additive is added to the fiber slurry. The fiber slurry having the adsorbable chemical additive is transported to a web-forming apparatus where a wet fibrous web is formed. The wet fibrous web may be dried to a predetermined consistency thereby forming a dried fibrous web having from between about 10 to about 100 percent retention of the adsorbable chemical additive. The dried fibrous web is transported to a paper machine where the dried fibrous web is mixed with water to form a wet slurry. In other embodiments, the fiber slurry can be processed to provide crumb fibers or wet lap fibers. The wet slurry containing the fibers having the adsorbable chemical additive adhered thereto is transported through the paper machine to form a finished paper or tissue product having enhanced quality due to the retention of the adsorbable chemical additive on the pulp fibers.

48 Claims, 3 Drawing Sheets

U.S. PATENT DOCUMENTS 5,223,090 A * 6/1993 Klungness et al. ..... 162/9
5,257,168 A 10/1993 Littman et al.
5,296,024 A 3/1994 Hutcheson
5,348,620 A 9/1994 Hermans et al.
5,393,334 A 2/1995 Hutcheson
5,443,899 A * 8/1995 Barcus et al. ..... 428/288
5,494,554 A 2/1996 Edwards et al.
5,501,768 A 3/1996 Hermans et al.
5,552,020 A 9/1996 Smith et al.
5,607,551 A 3/1997 Farrington, Jr. et al.
5,624,532 A * 4/1997 Trokhan et al. ..... 162/111
5,625,015 A 4/1997 Brinen et al.
5,649,915 A 7/1997 Chauvette et al.
5,656,132 A 8/1997 Farrington, Jr. et al.
5,667,636 A 9/1997 Engel et al.
5,672,248 A 9/1997 Wendt et al.
5,730,839 A 3/1998 Wendt et al.
5,753,079 A 5/1998 Jenny et al.
5,759,349 A * 6/1998 Foster et al. ..... 162/158
5,830,320 A * 11/1998 Park et al. ..... 162/164.1
5,928,470 A * 7/1999 Shannon ..... 162/9
6,074,524 A * 6/2000 Wu et al. ..... 162/100

* cited by examiner

METHOD FOR ADDING AN ADSORBABLE CHEMICAL ADDITIVE TO PULP DURING THE PULP PROCESSING AND PRODUCTS MADE BY SAID METHOD

BACKGROUND OF THE INVENTION

The present invention relates generally to paper or tissue products. More particularly, the invention concerns methods for applying adsorbable chemical additives to the fibers of pulps during the pulp processing and the paper products that can be obtained by the methods.

In the manufacture of paper products, it is often desirable to enhance physical and/or optical properties by the addition of chemical additives. Typically, chemicals such as softeners, colorants, brighteners, strength agents, etc. are added to the fiber slurry upstream of the headbox in a paper making machine during the manufacturing or converting stages of production to impart certain attributes to the finished product. These chemicals are usually mixed in a stock chest or stock line where the fiber slurry has a fiber consistency of from between about 0.15 to about 5 percent or spraying the wet or dry paper or tissue during production.

One disadvantage of adding a chemical at each paper machine is that the manufacturer has to install equipment on each paper machine to accomplish the chemical addition. This, in many cases, is a costly proposition. In addition, the uniformity of the finished product coming off of each paper machine may vary depending upon how the chemical was added, variations in chemical uniformity and concentrations, the exact point of chemical introduction, water chemistry differences among the paper machines as well as personnel and operational differences of each paper machine.

Another difficulty associated with wet end chemical addition is that the water soluble or water dispersible chemical additives are suspended in water and are not completely adsorbed onto the fibers prior to formation of the wet mat. To improve adsorption of wet end additives, chemical additives are often modified with functional groups to impart an electrical charge when in water. The electrokinetic attraction between charged additives and the anionically charged fiber surfaces aids in the deposition and retention of chemical additives onto the fibers. Nevertheless, the amount of chemical additive that can be retained in the paper machine wet end generally follows an adsorption curve exhibiting diminishing incremental adsorption with increasing concentration, similar to that described by Langmuir. As a result, the adsorption of water soluble or water dispersible chemical additives may be significantly less than 100 percent, particularly when trying to achieve high chemical additive loading levels.

Consequently, at any chemical addition level, and particularly at high addition levels, a fraction of the chemical additive is retained on the fiber surface. The remaining fraction of the chemical additive remains dissolved or dispersed in the suspending water phase. These unadsorbed chemical additives can cause a number of problems in the papermaking process. The exact nature of the chemical additive will determine the specific problems that may arise, but a partial list of problems that may result from unadsorbed chemical additives includes: foam, deposits, contamination of other fiber streams, poor fiber retention on the machine, compromised chemical layer purity in multi-layer products, dissolved solids build-up in the water system, interactions with other process chemicals, felt or fabric plugging, excessive adhesion or release on dryer surfaces, physical property variability in the finished product.

Therefore, what is lacking and needed in the art is a method for applying adsorbable chemical additives onto pulp fiber surfaces in the initial or primary pulp processing, providing more uniform chemical additions to the pulp fiber and a reduction or elimination of unadsorbed chemical additives in the process water on a paper machine. The method minimizes the associated manufacturing and finished product quality problems that would otherwise occur with conventional wet end chemical addition at the paper machine.

SUMMARY OF THE INVENTION

It has now been discovered that adsorbable chemical additives can be adsorbed onto pulp fibers that have never been dried at high and/or uniform levels with at most a minimal amount of unadsorbed chemical additives present in the papermaking process water after the treated pulp fiber has been redispersed in water. This is accomplished by treating a fiber slurry comprising pulp fiber and water with an excess of the adsorbable chemical additive, allowing sufficient residence time for adsorption to occur, and filtering or otherwise dewatering the fiber slurry to remove water and unadsorbed chemical additives.

Hence in one aspect, the invention resides in a method for applying adsorbable chemical additives to the pulp fibers. The method comprises creating a fiber slurry comprising water, pulp fibers that have never been dried, and an adsorbable chemical additive. The fiber slurry having the chemical additive may be formed into a wet fibrous web using a web forming apparatus. The wet fibrous web is dried to a predetermined consistency. In other embodiments of the present invention, the process may include further dewatering thereby forming a crumb-form. The dried fibrous web may have retained from between about 10 to about 100 percent of the adsorbable chemical additive.

According to another embodiment of the present invention is a method for adding an adsorbable chemical to the pulp fiber during the pulp processing prior to the drying stage. During the pulp processing, upstream of a paper machine, one can obtain chemically treated pulp fiber that is essentially homogeneous in chemical adsorption. Furthermore, the chemically treated pulp fiber can be transported to several different paper machines that may be located at various sites, and the quality of the finished product from each paper machine will be more consistent. Also, by chemically treating the pulp fiber before the pulp fiber is available for use on multiple paper machines or multiple runs on a paper machine, the need to install equipment at each paper machine for the adsorbable chemical addition can be eliminated.

This method for processing pulp fibers also enables higher and more uniform concentrations of adsorbable chemical additives to be adsorbed by the pulp fibers while at the same time maintaining significantly lower levels of unadsorbed chemical additive in the water phase of a papermaking machine compared to paper machine wet end chemical additions.

The term "adsorbable" is used herein to refer to a chemical additive that can be assimilated by the surface of a pulp fiber, in the absence of any chemical reaction involving the chemical additive and the fiber. Once the chemical additive is adsorbed, it may or may not be absorbed into the pulp fiber. The term "unadsorbed" refers to any portion of the adsorbable chemical additive that is not adsorbed by the pulp fiber and thus remains suspended in the process water. The term "web-forming apparatus" includes fourdrinier former, twin wire former, cylinder machine, press former, crescent former, and the like known to those skilled in the art.

The consistency of the fiber slurry is from about 0.5 to about 15 percent. In other embodiments, the consistency of the fiber slurry is from about 2 to about 10 percent or from about 3 to about 5 percent. The consistency of the dried fibrous web is from about 45 to about 100 percent. In other embodiments, the consistency of the dried fibrous web is from about 60 to about 100 percent or from about 85 to about 95 percent. The consistency of the wet fibrous web is from about 30 to about 45 percent. In other embodiments, the consistency of the wet fibrous web is from about 35 to about 45 percent or from about 40 to about 45 percent. The consistency of the crumb form is from about 50 to about 85 percent. In other embodiments, the consistency of the crumb form is from about 60 to about 85 percent or from about 80 to about 85 percent.

The present method allows for the production of pulp fibers that are useful for making paper products. This results in a pulp fiber, which after drying, has different mechanical properties than if the chemical treatment is carried out on pulp fiber in the once dried state. One aspect of the present invention is a more uniformly chemically treated pulp fiber, replacing the need for costly and variable chemical treatments at one or more paper machines. Another aspect of the invention resides in a pulp fiber that has a higher chemical additive loading than could otherwise be achieved in combination with no or a relatively low level of unadsorbed chemical additive in the process water on a paper machine. This is because chemical additive loading via wet end addition is often limited by the level of unadsorbed chemical and/or contact time, as well as its associated processing difficulties such as foam, deposits, chemical interactions, felt plugging, excessive dryer adhesion or release or a variety of paper physical property control issues caused by the presence of unadsorbed chemical in the process water on the paper machines.

In another embodiment, a fiber slurry of the present invention comprises water, pulp fibers having an adsorbable chemical additive adsorbed onto the fiber surface. The amount of chemical additive adsorbed onto the pulp fibers is about 0.1 kilogram per metric ton or greater, and the amount of unadsorbed chemical additive in the water is between 0 and about 90 percent of the amount of adsorbable chemical additive added to the pulp fibers. In particularly desirable embodiments, the amount of adsorbed chemical additive is about 0.5 kg/metric ton or greater, particularly about 1 kg/metric ton or greater, and more particularly about 2 kg/metric ton or greater. Once the wet or dried fibrous wet is redispersed at the paper machine, the amount of unadsorbed chemical additive in the water phase is between 0 and about 15 percent, particularly between 0 and about 10 percent, and more particularly between 0 and about 7 percent, of the amount of adsorbed chemical additive.

According to one embodiment of the present invention, the method for adding an adsorbable chemical additive to pulp fiber comprises creating a fiber slurry. The fiber slurry comprises water, pulp fibers that have never been dried, and an adsorbable chemical additive The fiber slurry having the adsorbable chemical additive is passed to a web-forming apparatus where a wet fibrous web is formed from the fiber slurry. The wet fibrous web is dried to a predetermined consistency. The resulting dried fibrous web may have from between about 10 to about 100 percent retention of the adsorbable chemical additive on the fibers. The dried fibrous web may be transported to a paper machine. The dried fibrous web is mixed with water to form a wet slurry. The wet slurry contains the fibers having the adsorbable chemical additive secured thereto. A finished product having enhanced quality due to the retention of the adsorbable chemical additive on the fibers may be produced from the wet slurry.

Another aspect of the present invention resides in a method for making chemically treated paper products. The method comprising mixing pulp fibers that have never been dried with water to form a fiber slurry. An adsorbable chemical additive is added to the fiber slurry. The fiber slurry, containing the adsorbable chemical additive is formed into a wet fibrous web. This may be accomplished in a web-forming apparatus. The wet fibrous web may be dried to a predetermined consistency. The resulting dried fibrous web may have from about 10 to about 100 percent retention of the chemical additive. The pulp fibers, as a dried fibrous web, may be transported or otherwise delivered to one or more paper machines. The pulp fiber, as a dried fibrous web, is mixed with water to form a wet slurry. The wet slurry contains the pulp fibers having the adsorbable chemical additive secured thereto. A finished product having enhanced qualities due to the retention of the adsorbable chemical additive on the fibers may be produced.

Another aspect of the present invention resides in a method for making chemically treated finished paper or tissue products. The method comprising mixing pulp fibers that have never been dried with water to form a fiber slurry. An adsorbable chemical additive is added to the fiber slurry. The fiber slurry, containing the adsorbable chemical additive is formed into a wet fibrous web. This may be accomplished in a web-forming apparatus. The wet fibrous web may be dewatered to a predetermined consistency. In other embodiments, the pulp fiber may be processed to a wet lap or processed to a crumb form. The resulting pulp fiber may have from about 10 to about 100 percent retention of the adsorbable chemical additive. The pulp fibers, once treated with the adsorbable chemical additive, may be transported or otherwise delivered to one or more paper machines in the form of a wet fibrous web, a dried fibrous web, a wet lap, or a crumb form. The pulp fiber, as a wet fibrous web, a wet lap, or a crumb form, is mixed with water to form a wet slurry. The wet slurry contains the pulp fibers having the adsorbable chemical additive secured thereto. A finished product having enhanced qualities due to the retention of the adsorbable chemical additive on the fibers is produced.

Another aspect of the present invention resides in a method for making chemically treated paper products. The method comprises creating a fiber slurry comprising water, pulp fibers that have never been dried, and a first adsorbable chemical additive. At least a second adsorbable chemical additive may be added to the fiber slurry, thereby forming a multi-treated fiber slurry. The additional adsorbable chemical additives may be added simultaneously with the first adsorbable chemical additives or at different times or points of the pulp processing. The additional adsorbable chemical additives may be added simultaneously or at different times or points of the pulp processing. The multi-treated fiber slurry, containing the adsorbable chemical additives, is formed into a wet fibrous web. This may be accomplished in a web-forming apparatus. The wet fibrous web may be dried to a predetermined consistency. The resulting dried fibrous web may have from about 10 to about 100 percent retention of the adsorbable chemical additives. The pulp fibers, as a multi-treated dried fibrous web, is transported or otherwise delivered to one or more paper machines. The pulp fiber, as a multi-treated dried fibrous web, is mixed with water to form a wet slurry. The wet slurry contains the pulp fibers having the adsorbable chemical additives secured thereto. A finished product having enhanced qualities due to the retention of the adsorbable chemical additives on the fibers may be produced.

In other aspects of the present invention reside a method for making chemically treated paper products. The method comprises creating a fiber slurry comprising water, pulp fibers that have never been dried, and a first adsorbable chemical additive. At least a second adsorbable chemical additive may be added to the fiber slurry, thereby forming a multi-treated fiber slurry. The second or additional adsorbable chemical additives may be added simultaneously with the first adsorbable chemical additive or at different times or points of the pulp processing. The additional adsorbable chemical additives may be added simultaneously or at different times or points of the pulp processing. The multi-treated fiber slurry, containing the adsorbable chemical additives, is formed into a wet fibrous web. This may be accomplished in a web-forming apparatus. The wet fibrous web may be dried to a predetermined consistency. In other embodiments, the pulp fiber may be processed to a wet lap or processed to a crumb form. The resulting pulp fiber may have from about 10 to about 100 percent retention of the adsorbable chemical additives. The pulp fibers, once treated with the adsorbable chemical additives, may be transported or otherwise delivered to one or more paper machines in the form of a wet fibrous web, a wet lap, or a crumb form. The pulp fiber, as a multi-treated wet fibrous web, a wet lap, or a crumb form, is mixed with water to form a wet slurry. The wet slurry contains the pulp fibers having the adsorbable chemical additives secured thereto. A finished product having enhanced qualities due to the retention of the adsorbable chemical additives on the fibers may be produced.

The present invention is particularly useful for adding adsorbable chemical additives such as softening agents to the pulp fibers, allowing for the less problematic and lower cost production of finished products having enhanced qualities provided by the retained adsorbable chemical additives.

Hence, another aspect of the present invention resides in paper products formed from pulp fibers that have been chemically treated prior to a drying phase to minimize the amount of residual, unadsorbed chemical additives in the process water on a paper machine. The term "paper" is used herein to broadly include writing, printing, wrapping, sanitary, and industrial papers, newsprint, linerboard, tissue, bath tissue, facial tissue, napkins, wipers, wet wipes, towels, absorbent pads, intake webs in absorbent articles such as diapers, bed pads, meat and poultry pads, feminine care pads, and the like made in accordance with any conventional process for the production of such products. With regard to the use of the term "paper" as used herein includes any web containing cellulosic fibers alone or in combination with other fibers, natural or synthetic. It can be layered or unlayered, creped or uncreped, and can consist of a single ply or multiple plies. In addition, the paper or tissue web can contain reinforcing fibers for integrity and strength.

The adsorbable chemical additives that can be used in conjunction with the present invention include: dry strength aids, wet strength aids, softening agents, adsorbency aids, sizing agents, dyes, optical brighteners, chemical tracers, opacifiers, dryer adhesive chemicals, and the like. Additional forms of adsorbable chemical additives may include: pigments, emollients, humectants, viricides, bactericides, buffers, waxes, fluoropolymers, odor control materials and deodorants, zeolites, perfumes, vegetable and mineral oils, humectants, sizing agents, surfactants, moisturizers, UV blockers, antibiotic agents, lotions, fungicides, preservatives, aloe-vera extract, vitamin E, or the like. Suitable adsorbable chemical additives are adsorbable by the papermaking fibers and are water soluble or water dispersible.

The term "softening agent" refers to any adsorbable chemical additive that can be incorporated into paper products such as tissue to provide improved tactile feel and reduce paper stiffness. A softening agent may be selected from the group consisting of quaternary ammonium compounds, quaternized protein compounds, phospholipids, silicone quaternaries, quaternized, hydrolyzed wheat protein/dimethicone phosphocopolyol copolymer, organoreactive polysiloxanes, and silicone glycols. These adsorbable chemical additives can also act to reduce paper stiffness or can act solely to improve the surface characteristics of tissue, such as by reducing the coefficient of friction between the tissue surface and the hand.

The term "dye" refers to any adsorbable chemical that can be incorporated into paper products, such as bathroom tissue, facial tissue, paper towels, and napkins, to impart a color. Depending on the nature of the adsorbable chemical, dyes may be classified as acid dyes, basic dyes, direct dyes, cellulose reactive dyes, or pigments. All classifications are suitable for use in conjunction with the present invention.

The term "water soluble" refers to solids or liquids that will form a solution in water, and the term "water dispersible" refers to solids or liquids of colloidal size or larger that can be dispersed into an aqueous medium.

The method for applying adsorbable chemical additives to the pulp fibers may be used in a wide variety of pulp finishing processing, including dry lap pulp, wet lap pulp, crumb pulp, and flash dried pulp operations. By way of illustration, various pulp finishing processes (also referred to as pulp processing) are disclosed in *Pulp and Paper Manufacture: The Pulping of Wood*, 2nd Ed., Volume 1, Chapter 12. Ronald G. MacDonald, editor, which is incorporated by reference.

In addition, in situations where more than one adsorbable chemical additive is to be employed, the adsorbable chemical additives may be added to the fiber slurry in sequence to reduce interactions between the adsorbable chemical additives. In other situations, the adsorbable chemical additives may be removed from the fiber slurry after another adsorbable chemical additive has been added to facilitate the removal process.

Many fiber types may be used for the present invention including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulose fibers, cellulose derivatives, and chemically stiffened or crosslinked fibers), some component portion of synthetic fiber (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulp processings), thermomechanically pulped, chemithermomechanically pulped, and the like. Mixtures of any subset of the above mentioned or related fiber classes may be used. The pulp fibers can be prepared in a multiplicity of ways known to be advantageous in the art. Useful methods of preparing fibers include dispersion to impart curl and improved drying properties, such as disclosed in U.S. Pat. No. 5,348,620 issued Sep. 20, 1994 and U.S Pat. No. 5,501,768 issued Mar. 26, 1996, both to M. A. Hermans et al. and U.S. Pat. No. 5,656,132 issued Aug. 12, 1997 to Farrington, Jr. et al.

According to the present invention, the adsorbable chemical treatment of the pulp fibers occurs prior to the drying phase of the pulp processing. The two generally accepted methods of drying include flash drying and can drying. Flash drying is most common with bleached, chemi-thermo-mechanical pulp (BCTMP). The present invention may also be applied to wet lap pulp processes without the use of can or flash dryers.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION

The invention will now be described in greater detail with reference to the Figures. A variety of conventional pulping apparatuses and operations can be used with respect to the pulping phase, pulp processing, and drying of pulp. Nevertheless, particular conventional components are illustrated for purposes of providing the context in which the various embodiments of the invention can be used.

Figure 1:
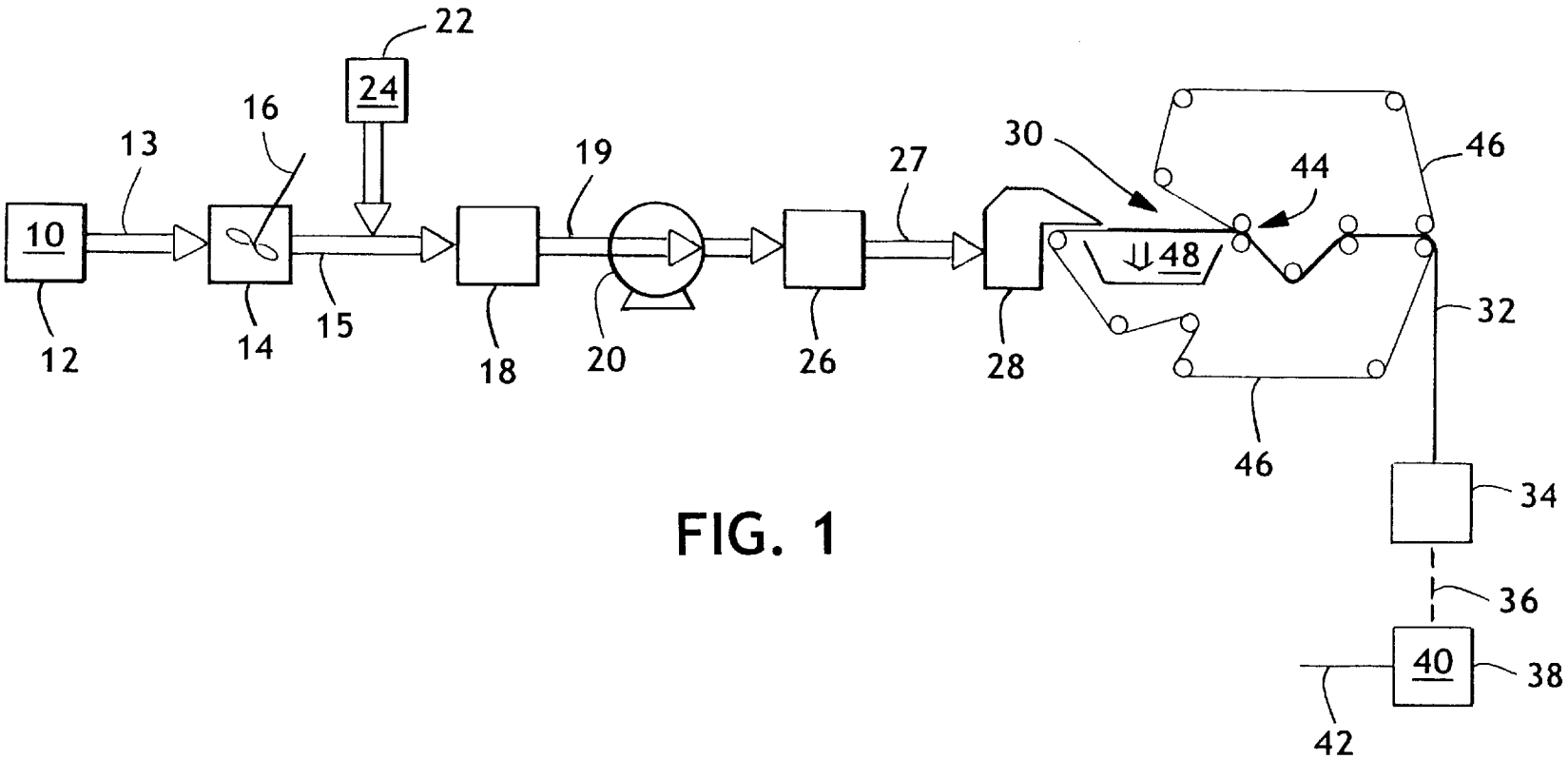
FIG. 1 depicts a schematic process flow diagram of a method according to the present invention for treating pulp fibers with adsorbable chemical additives.

FIG. 1 depicts pulp processing preparation equipment used to apply adsorbable chemical additives to pulp fibers according to one embodiment of the present invention. The pulp processing equipment comprises a (high density) storage tank 12 where the bleached and never dried pulp fiber is held in the form of a fiber slurry 10 comprised of the pulp fiber and water. The consistency of the fiber slurry 10 when contained in the storage tank 12 may range from about 10 to about 12 percent fiber. In other embodiments, the consistency of the fiber slurry 10 in the storage tank 12 may range from about 8 to about 15 percent fiber.

The fiber slurry 10 is diluted and transferred from the storage tank 12 through suitable conduits 13 to the blend chest 14 where the fiber slurry 10 is subjected to agitation using a mixing blade, rotor, recirculation pump, or other suitable device 16, thereby reducing variations in the fiber slurry 10. The consistency of the fiber slurry 10 in the blend chest 14 may be from about 0.5 to about 15 percent fiber. In other embodiments, the consistency of the fiber slurry 10 in the blend chest 14 may be from about 2 to about 10 percent fiber or from about 3 to about 5 percent fiber.

The fiber slurry 10 is transferred from the blend chest 14 through suitable conduits 15 to a machine chest 18. The consistency of the fiber slurry 10 in the machine chest 18 may be from about 0.5 to about 15 percent fiber. In other embodiments, the consistency of the fiber slurry 10 in the machine chest 18 may be from about 2 to about 10 percent fiber or from about 3 to about 5 percent fiber.

One or more adsorbable chemical additives 24 are supplied from a reservoir 22 and added to the fiber slurry 10 in the conduit 16 prior to the machine chest 18. The amount of adsorbable chemical additive 24 is suitably about 0.1 kg./metric ton of pulp fiber or greater. In particular embodiments, the adsorbable chemical additive 24 comprises a softening agent and is added in an amount from about 0.1 kg./metric ton of pulp fiber or greater. The fiber slurry 10 and the adsorbable chemical additive 24 are desirably allowed to remain together in the machine chest 18 under agitation for a residence time sufficient to allow the pulp fibers to adsorb a substantial portion of the adsorbable chemical additive 24. A residence time of at least about 10 minutes, for instance may be sufficient. In other embodiments, the residence time may range from about 10 seconds to about 30 minutes or from about 2 minutes to about 15 minutes.

The fiber slurry 10 is thereafter transferred from the machine chest 18 through suitable conduits 19 and a fan pump 20 to the screen device 26 where contaminates are removed based on size. The consistency of the fiber slurry 10 is typically decreased at some point during the transfer from the machine chest 18 to the fan pump 20. One example of the screen device 26 is a slotted screen or a pressure screen. The fiber slurry 10 may also be subjected to a series of centricleaners (not shown) to remove heavy particles from the fiber slurry 10 and an atenuator (not shown) to reduce the variability of the pressure going into the headbox 28.

The fiber slurry 10 is thereafter transferred through suitable conduits 27 to the headbox 28 where the fiber slurry 10 is injected or deposited into a fourdrinier section 30 thereby forming a wet fibrous web 32. The wet fibrous web 32 may be subjected to mechanical pressure to remove water and unadsorbed chemical additive 24. In the illustrated embodiment, the fourdrinier section 30 precedes a press section 44, although alternative dewatering devices such as a nip thickening device, or the like may be used. The fiber slurry 10 is deposited onto a foraminous fabric 46 such that the fourdrinier section filtrate 48 is removed from the wet fibrous web 32. The fourdrinier section filtrate 48 comprises a portion of the process water in addition to the unabsorbed chemical additive 24 in the water. The press section 44 or other dewatering device suitably increases the fiber consistency of the wet fibrous web 32 to about 30 percent or greater, and particularly about 40 percent or greater. The water and unadsorbed chemical. additive 24 removed as fourdrinier section filtrate 48 during the web forming step may be used as dilution water for dilution stages in the pulp processing, as the dilution water base for the adsorbable chemical additive 24, or discarded. But, importantly, the fourdrinier section filtrate 48 containing the unadsorbed chemical additive 24 is not sent forward with the pulp fiber into the papermaking process.

The wet fibrous web 32 may be transferred to a dryer section 34 where evaporative drying is carried out on the wet fibrous web 32 to an airdry consistency, thereby forming a dried fibrous web 36. The dried fibrous web 36 is thereafter slit, cut into sheets, and baled for delivery to paper machines 38. At the paper machines 38, the dried fibrous web 36 is mixed with water to form a wet slurry 40. The wet slurry 40 contains the pulp fiber having the adsorbable chemical additive 24 adhered to the individual fibers. The wet slurry 40 is passed through the papermaking machine and processed to form a finished product 42. By way of illustration, various paper or tissue making processes are disclosed in U.S. Pat. No. 5,667,636 issued Sep. 16, 1997 to Engel et al.; U.S. Pat. No. 5,607,551 issued Mar. 4, 1997 to Farrington, Jr. et al.; U.S. Pat. No. 5,672,248 issued Sep. 30, 1997 to Wendt et al.; and, U.S. Pat. No. 5,494,554 issued Feb. 27, 1996 to Edwards et al., which are incorporated herein by reference. The finished product 42 has enhanced qualities due to the retention of the adsorbable chemical additive 24 onto the pulp fibers during the pulp processing.

In other embodiments of the present invention, the adsorbable chemical additives 24 may be added to the fiber slurry 10 at a variety of positions in the pulp processing apparatus. In the alternative, the adsorbable chemical additives 24 may be added to the fiber slurry 10 at the storage tank 12, the blend chest 14, the machine chest 18, the fan pump 20, the screen device 26, or any of the conduits 13, 15, and 19 through which the fiber slurry 10 is transferred. To enhance the absorption of the adsorbable chemical additives 24 onto the pulp fibers of the fiber slurry 10, agitation devices 16 may be utilized. In the conduits 13, 15, and 19, the agitation devices 16 may include static mixers such as baffles, or kinetic mixers such as pumps.

In another embodiment, a second machine chest 21 may be included in the pulp processing apparatus. (See FIG. 2.) The second machine chest 21 may be disposed between the first machine chest 18 and the fan pump 20.

Figure 2:
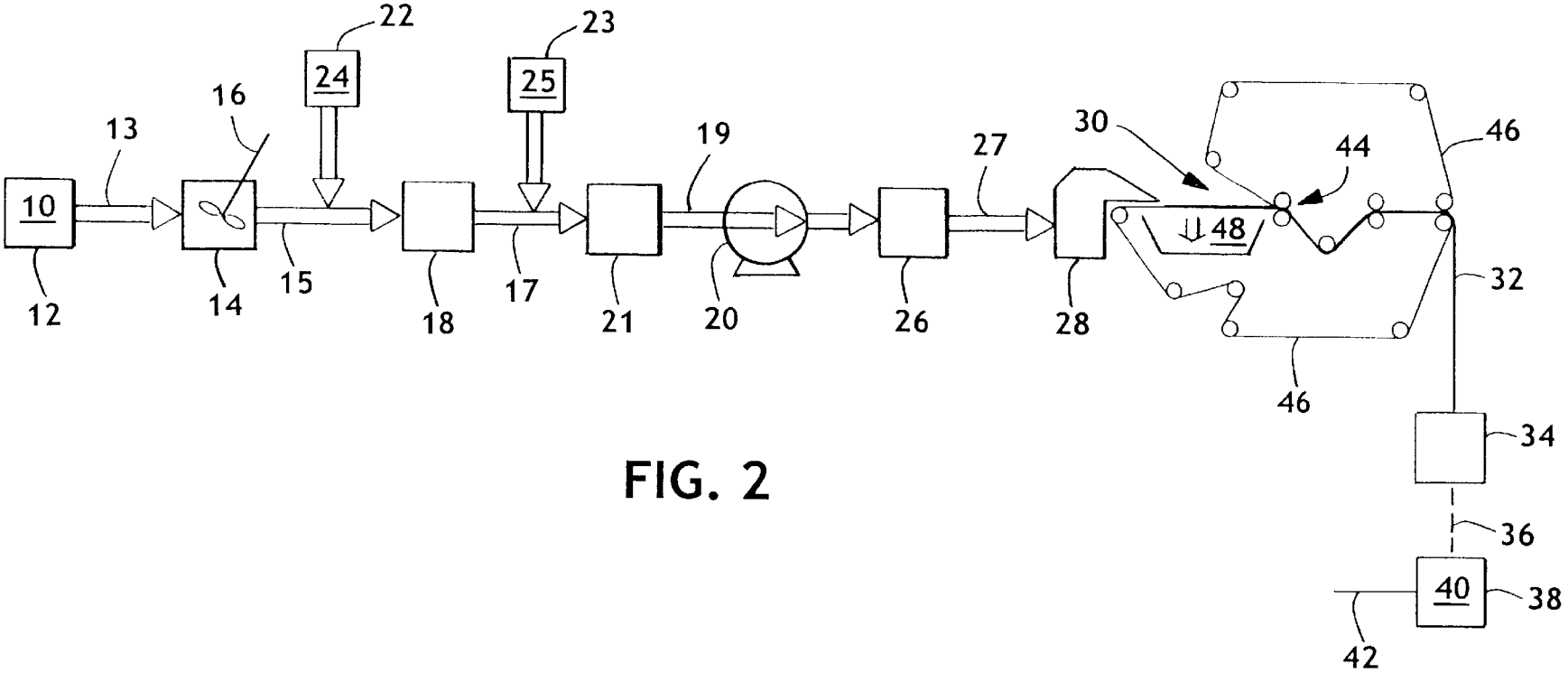
FIG. 2 depicts a schematic process flow diagram of a method according to the present invention for treating pulp fibers with multiple adsorbable chemical additives.

FIG. 2 depicts an alternative embodiment of the present invention in which sequential addition of adsorbable chemical additives 24 and 26 are added to the fiber slurry 10. The pulp processing equipment comprises a (high density) storage tank 12 where the bleached and never dried pulp fiber is held in the form of a fiber slurry 10 comprised of the pulp fiber and water. The consistency of the fiber slurry 10 when contained in the storage tank 12 may range from about 10 to about 12 percent fiber. In other embodiments, the consistency of the fiber slurry 10 in the storage tank 12 may range from about 8 to about 15 percent fiber.

The fiber slurry 10 is diluted and transferred from the storage tank 12 through suitable conduits 13 to the blend chest 14 where the fiber slurry 10 is subjected to agitation using a mixing blade, rotor, recirculation pump, or other suitable device 16, thereby reducing variations in the fiber slurry 10. The consistency of the fiber slurry 10 in the blend chest 14 may be from about 0.5 to about 15 percent fiber. In other embodiments, the consistency of the fiber slurry in the blend chest 14 may be from about 2 to about 10 percent fiber or from about 3 to about 5 percent fiber.

The fiber slurry 10 is transferred from the blend chest 14 through suitable conduits 15 to the machine chest 18. The consistency of the fiber slurry 10 in the machine chest 18 may be from about 0.5 to about 15 percent fiber. In other embodiments, the consistency of the fiber slurry 10 in the machine chest 18 may be from about 2 to about 10 percent fiber or from about 3 to about 5 percent fiber.

A first adsorbable chemical additive 24, comprising one or more adsorbable chemical components, is supplied from a reservoir 22 and added to the fiber slurry 10 in a suitable conduit 15 prior to the machine chest 18. The amount of first adsorbable chemical additive 24 is suitably about 0.1 kg./metric ton of pulp fiber or greater. In particular embodiments, wherein the first adsorbable chemical additive 24 is a softening agent and is added in an amount from about 0.1 kg./metric ton of pulp fiber or greater. The fiber slurry 10 and the first adsorbable chemical additive 24 are desirably allowed to remain together in the machine chest 18 under agitation for a residence time sufficient to allow the pulp fibers to adsorb a substantial portion of the first adsorbable chemical additive 24. A residence time of at least about 10 minutes, for instance may be sufficient. In other embodiments, the residence time may range from about 10 seconds to about 30 minutes or from about 2 minutes to about 15 minutes.

The fiber slurry 10 containing the first adsorbable chemical additive 24 is transferred from the machine chest 18 through suitable conduits 17 to the second machine chest 21. A second adsorbable chemical additive 25, comprising one or adsorbable chemical additives, is supplied from a second reservoir 23 and added to the fiber slurry 10 in a suitable conduit 17 prior to the second machine chest 21. The amount of the second adsorbable chemical additive 25 is suitably about 0.1 kg./metric ton of pulp fiber or greater. In particular embodiments, wherein the second adsorbable chemical additive 25 is a softening agent and is added in an amount from about 0.1 kg./metric ton of pulp fiber or greater. The fiber slurry 10 and the second adsorbable chemical additive 25 are desirably allowed to remain together in the second machine chest 21 under agitation for a residence time sufficient to allow the pulp fibers to adsorb a substantial portion of the second adsorbable chemical additive 25. A residence time of at least about 10 minutes, for instance may be sufficient. In other embodiments, the residence time may range from about 10 seconds to about 30 minutes or from about 2 minutes 10 to about 15 minutes.

The fiber slurry 10 containing the first and second adsorbable chemical additives 24 and 25 is thereafter transferred from the second machine chest 21 through suitable conduits 19 and a fan pump 20 to the screen device 26 where contaminates are removed based on size. One example of the screen device 26 is a slotted screen or pressure screen. The fiber slurry 10 may also be subjected to a series of centricleaners (not shown) to remove heavy particles from the fiber slurry 10 and an atenuator (not shown).

The fiber slurry 10 is thereafter transferred through suitable conduits 27 to the headbox 28 where the fiber slurry 10 is injected or deposited into a fourdrinier section 30 thereby forming a wet fibrous web 32. The wet fibrous web 32 may be subjected to mechanical pressure to remove water and unadsorbed chemical additive 24.

The wet fibrous web 32 may be transferred to a dryer section 34 where evaporative drying is carried out on the wet fibrous web 32, thereby forming a dried fibrous web 36. The dried fibrous web 36 is thereafter slit, cut into sheets, and baled for delivery to paper machines 38. At the paper machines 38, the dried fibrous web 36 is mixed with water to form a wet slurry 40. The wet slurry 40 contains the pulp fiber having the first and second adsorbable chemical additives 24 and 25 adhered to the individual fibers. The wet slurry 40 is passed through the paper machine and processed to form a finished product 42. The finished product 42 has enhanced qualities due to the retention of the first and second adsorbable chemical additives 24 and 25 onto the pulp fibers during the pulp processing.

In other embodiments of the present invention, each of the first and second adsorbable chemical additives 24 and 25 may be added to the fiber slurry 10 at a variety of positions in the pulp processing apparatus. In alternative embodiments, the first and second adsorbable chemical additives 24 and 25 may be added to the fiber slurry 10 at the storage tank 12, the blend chest 14, the first or second machine chests 18 and 21, the fan pump 20, the screen device 26, or any of the conduits 13, 15, 17, and 19 through which the fiber slurry 10 is transferred. In addition, the first and second adsorbable chemical additives 24 and 25 may be added to the same piece of pulp processing equipment at different times, such as the addition of the second adsorbable chemical additive 25 to the blend chest 14 after a sufficient residence time has elapsed after the addition of the first adsorbable chemical additive 24 to the blend chest 14. To enhance the uniformity of the absorption of the first and second adsorbable chemical additives 24 and 25 onto the pulp fibers of the fiber slurry 10, agitation devices 16 may be utilized. In the conduits 13, 15, and 19, the agitation devices 16 may include static mixers such as baffles, or kinetic mixers such as pumps.

In other embodiments of the present invention, one batch of pulp fibers may be treated with a first chemical additive according to the method of the present invention as discussed above while a second batch of pulp fibers may be treated with a second chemical additive according to the present invention. During the papermaking process, different pulp fibers or pulp fibers having different treatments may be processed into a layered paper or tissue product as disclosed in the U.S. Pat. No. 5,730,839 issued Mar. 24, 1998 to Wendt et al., which is incorporated herein by reference.

Figure 3:
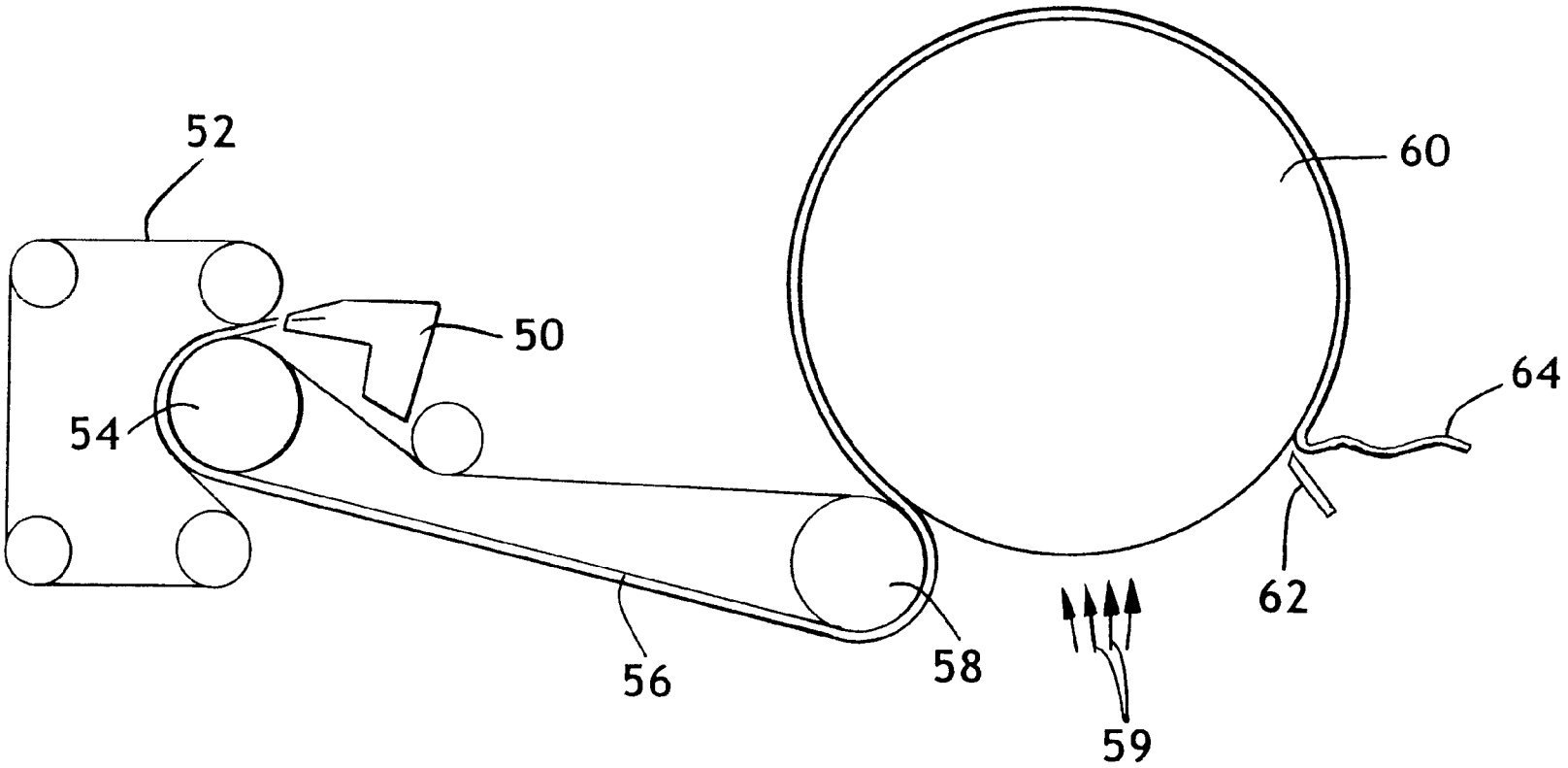
FIG. 3 depicts a schematic process flow diagram of a method of making a creped tissue sheet.

Referring to the FIG. 3, a tissue web 64 is formed using a 2-layer headbox 50 between a forming fabric 52 and a conventional wet press papermaking (or carrier) felt 56 which wraps at least partially about a forming roll 54 and a press roll 58. The tissue web 64 is then transferred from the papermaking felt 56 to the Yankee dryer 60 applying the vacuum press roll 58. An adhesive mixture is typically sprayed using a spray boom 59 onto the surface of the Yankee dryer 60 just before the application of the tissue web to the Yankee dryer 60 by the press roll 58. A natural gas heated hood (not shown) may partially surround the Yankee dryer 60, assisting in drying the tissue web 64. Two tissue webs 64 may be plied together and calendered. The resulting 2-ply tissue product can be wound onto a hard roll.

EXAMPLES

Example 1

This example will describe how to produce chemically modified pulp as described according to the present invention. Referencing FIG. 1, the fully bleached eucalyptus pulp fiber slurry having about 10% solids was diluted to about 2.5% solids in the conduit as the fiber slurry was pumped out of the high density storage tank. The fiber slurry was then pumped to the blend chest. As the fiber slurry was transferred from the blend chest to the machine chest through a conduit, a 1 percent dispersion of an imidazoline softening agent (methyl-1-oleyl amidoethyl-2-oleyl imidazolinium methylsulfate identified as Mackernium DC-183, commercially available from McIntyre Ltd., located in University Park, Ill.), was mixed into the fiber slurry.

The dosage of the chemical softener was 3 kilograms per tonne of eucalyptus pulp fiber in the fiber slurry. The chemical softener was mixed with the fiber slurry in the machine chest for about 10 minutes. The fiber slurry was then diluted to about 0.6% solids and used to form a wet fibrous web on the wet end of a dry lap machine.

During the formation of the wet fibrous web, a substantial portion of the chemical softener remained attached to the pulp fiber in the fiber slurry. The unadsorbed chemical softener remained in the water phase, which was drained as filtrate from the pulp fiber. The wet fibrous web was pressed in a press section and dried in a dryer section, thereby forming a dried fibrous web having 90% solids. As treated, the pulp fiber was now in the form to be used as a raw material in the tissue papermaking process.

The filtrate removed during the drainage step was recycled back in the process and used for the dilution of the fiber slurry in the conduits. Recycling of the filtrate containing the unadsorbed Mackernium DC-183 chemical softener provided additional opportunities for adsorption of the chemical softener by the pulp fiber of the fiber slurry.

Example 2

A layered soft tissue product was made using the pulp fiber produced according to the process disclosed in Example 1. The tissue product was made using the overall process shown in FIG. 3. The first stock layer contained the chemically treated Eucalyptus hardwood pulp fiber produced as described in Example 1, which made up about 65 percent of thee tissue web by weight. This first stock layer was the first layer to come into contact with the forming fabric and was also the layer that came into contact with the drying surface of the Yankee dryer. The second stock layer contained northern softwood kraft pulp fiber. The second stock layer made up about 35 percent of the tissue web by weight. A modified polyacrylamide dry strength agent, Hercobond 1366 commercially available from Hercules Inc. located in Wilmington, Del., was added to the pulp fiber of the softwood layer. The Hercobond 1366 was added to the thick stock, that was at about 1.9% solids, at an addition level of about 0.3% of the pulp As fiber in the entire tissue web. A polyamide epichlorohydrin wet strength agent, Kymene 557LX commercially available from the Hercules, lnc., was added to both the Eucalyptus and northern softwood kraft furnishes at an addition level of about 0.2% based on the pulp fiber in the entire tissue web.

Referring to the FIG. 3, the tissue web was formed using a 2-layer headbox between an Albany P-621 forming fabric commercially available from Albany International Corp., located in Menasha, Wis., and a conventional wet press papermaking (or carrier) felt (Weavex M1C commercially available from Weavex located in Wake Forest, N.C.) which wraps at least partially about a forming roll and a press roll. The basis weight of the tissue web was about 7.3 pounds per 2880 square feet of air dried tissue web.

The tissue web was then transferred from the papermaking felt to the Yankee dryer by the vacuum press roll. The water content of the tissue web on the papermaking felt just prior to transfer of the tissue web to the Yankee dryer was about 87 percent. The moisture content of the tissue web after the application of the press roll was about 55 percent. An adhesive mixture was sprayed using a spray boom onto the surface of the Yankee dryer just before the application of the tissue web by the press roll. The adhesive mixture consisted of about 40% polyvinyl alcohol, about 40% polyamide resin and about 20% quaternized polyamido amine as disclosed in U.S. Pat. No. 5,730,839 issued to Wendt et al. which is herein incorporated by reference. The application rate of the adhesive mixture was about 5.5 pounds of dry adhesive per tonne of dry pulp fiber in the tissue web. A natural gas heated hood (not shown) partially surrounding the Yankee dryer had a supply air temperature of about 680° to assist in drying the tissue web. The temperature of the tissue web after the application of the creping doctor was about 240° as measured with a handheld infrared temperature gun. The machine speed of the 24 inch wide tissue web was about 3000 feet per minute. The crepe ratio was about 1.30 or about 30%.

Two tissue webs were unwound from two soft rolls (or parent rolls) and plied together and calendered with two steel rolls at 90 pounds per lineal inch. The 2-ply tissue product was constructed such that the first stock layer containing the chemically treated Eucalyptus pulp fiber disclosed in Example 1 was plied to the outside of the 2-ply tissue product which was wound onto a hard roll. The hard roll is converted into finished product, such as facial tissue and the like. The finished basis weight of the 2-ply tissue product at standard TAPPI standard temperature and humidity was about 17.1 pounds per 2880 square feet. The MD tensile was about 951 grams per 3 inches and the CD tensile was about 449 grams per 3 inches. The thickness of one 2-ply tissue product was about 0.0097 inches. The MD stretch in the finished tissue product was about 23.3 percent. All tensile tests were conducted at standard TAPPI conditions.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. A method for preparing pulp comprising:

a) creating a fiber slurry comprising water, pulp fibers that have never been dried and an adsorbable chemical additive wherein said adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols;

b) transporting said fiber slurry having said adsorbable chemical additive to a web-forming apparatus and forming a wet fibrous web; and, c) drying said wet fibrous web to a predetermined consistency thereby forming a dried fibrous web having from between about 10 to about 100 percent retention of said adsorbable chemical additive.

2. The method of claim 1, wherein said method further comprises transporting said dried fibrous web to a paper machine and mixing said dried fibrous web with water to form a wet slurry, said wet slurry containing fibers having said adsorbable chemical additive secured thereto.

3. The method of claim 2, wherein said method further comprises producing a finished paper or tissue product having enhanced quality due to the retention of said adsorbable chemical additive on said fibers.

4. The method of claim 1, wherein creating a fiber slurry comprises adding said adsorbable chemical additive to an aqueous solution comprising said water and said pulp fibers.

5. The method of claim 1, wherein said adsorbable chemical additive is added to said slurry of water and pulp fibers in an amount of about 0.1 kilograms per metric ton or greater.

6. The method of claim 1, wherein said dried fibrous web has a consistency ranging from about 45 percent to about 100 percent.

7. The method of claim 1, wherein said dried fibrous web has a consistency ranging from about 85 percent to about 95 percent.

8. The method of claim 1, wherein sufficient residence time is provided after said adsorbable chemical additive is added to allow for absorption of said adsorbable chemical additive onto said pulp fiber.

9. The method of claim 1, further comprising forming a paper or tissue product from said dried fibrous web.

10. A paper or tissue product made using the method of claim 1.

11. The paper or tissue product of claim 10, wherein the amount of said chemical additive added to said pulp fibers is about 0.1 kilogram per metric ton or greater.

12. A method for adding an adsorbable chemical to pulp, said method comprising:

a) mixing pulp fibers that have never been dried with water to form a fiber slurry;

b) adding an adsorbable chemical additive to said fiber slurry wherein said adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols;

c) transporting said fiber slurry having said adsorbable chemical additive to a web-forming apparatus and forming a wet fibrous web;

d) drying said wet fibrous web to a predetermined consistency thereby forming a dried fibrous web having from between about 10 to about 100 percent retention of said adsorbable chemical additive;

e) transporting said dried fibrous web to a paper machine and mixing said dried fibrous web with water to form a wet slurry, said wet slurry containing fibers having said adsorbable chemical additive adhered thereto; and, f) transporting said wet slurry through said paper machine to form a finished paper or tissue product having enhanced quality due to the retention of said adsorbable chemical additive on said pulp fibers.

13. The fiber slurry of claim 12, wherein the amount of said chemical additive adsorbed onto said pulp fibers is about 0.1 kilogram per metric ton or greater, and the amount of unadsorbed said chemical additive in said water is between 0 and about 90 percent of the amount of said chemical additive added to said pulp fibers.

14. The fiber slurry of claim 12, wherein the amount of said chemical additive added to said pulp fibers is about 1 kilograms per metric ton or greater.

15. The fiber slurry of claim 12, wherein the amount of said chemical additive added to said pulp fibers is about 3 kilograms per metric ton or greater.

16. The fiber slurry of claim 12, wherein the amount of said chemical additive added to said pulp fibers is about 5 kilograms per metric ton or greater.

17. A paper or tissue product made from said fiber slurry of claim 12.

18. A method for adding an adsorbable chemical additive to pulp fiber, said method comprising:

a) creating a fiber slurry comprising water, pulp fibers that have never been dried and at least a first adsorbable chemical additive wherein said first adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols; and a second adsorbable chemical additive;

b) transporting said fiber slurry having at least said first and second adsorbable chemical additives to a web-forming apparatus and forming a wet fibrous web; and, c) drying said wet fibrous web to a predetermined consistency thereby forming a dried fibrous web having from between about 10 to about 100 percent retention of at least said first and second adsorbable chemical additives.

19. The method of claim 18, wherein said method further comprises transporting said dried fibrous web to a paper machine and mixing said dried fibrous web with water to form a wet slurry, said wet slurry containing fibers having said adsorbable chemical additive secured thereto.

20. The method of claim 19, wherein said method further comprises producing a finished paper or tissue product having enhanced quality due to the retention of said adsorbable chemical additive on said fibers.

21. The method of claim 18, 19, or 20, wherein said second adsorbable chemical additive is selected from the group comprising softening agents, dry strength agents, wet strength agents, opacifying agents, dyes, and mixtures thereof.

22. The method of claim 21, wherein said softening agent is selected from the group consisting of quaternary ammonium compounds, quaternized protein compounds, phospholipids, silicone quaternaries, quaternized, hydrolyzed wheat protein/dimethicone phosphocopolyol copolymer, organoreactive polysiloxanes, and silicone gylcols.

23. The method of claim 18, wherein creating a fiber slurry comprises adding said first and second adsorbable chemical additives to an aqueous solution comprising said water and said pulp fibers.

24. The method of claim 18, wherein said first adsorbable chemical additive is added to a slurry of water and pulp fibers in an amount of about 0.1 kilograms per metric ton or greater.

25. The method of claim 18, wherein said second adsorbable chemical additive is added to a slurry of water and pulp fibers in an amount of about 0.1 kilogram per metric ton or greater.

26. The method of claim 18, wherein said dried fibrous web has a consistency ranging from about 45 percent to about 100 percent.

27. The method of claim 18, wherein said dried fibrous web has a consistency ranging from about 85 percent to about 95 percent.

28. The method of claim 18, wherein sufficient residence time is provided after said first adsorbable chemical additive is added to allow for absorption of said first adsorbable chemical additive onto said pulp fiber.

29. The method of claim 18, wherein sufficient residence time is provided after said second adsorbable chemical additive is added to allow for absorption of said second adsorbable chemical additive onto said pulp fiber.

30. A paper or tissue product made using the method of claim 18.

31. A method for adding an adsorbable chemical to pulp, said method comprising:

a) mixing pulp fibers that have never been dried with water to form a fiber slurry;

b) adding a first adsorbable chemical additive to said fiber slurry wherein said first adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols;

c) adding at least a second adsorbable chemical additive to said fiber slurry;

d) transporting said fiber slurry having at least said first and second adsorbable chemical additives to a web-forming apparatus and forming a wet fibrous web;

e) drying said wet fibrous web to a predetermined consistency thereby forming a dried fibrous web having from between about 10 to about 100 percent retention of at least said first and second adsorbable chemical additives;

f) transporting said dried fibrous web to a paper machine and mixing said dried fibrous web with water to form a wet slurry, said wet slurry containing fibers having at least said first and second adsorbable chemical additives adhered thereto; and, g) transporting said wet slurry through said paper machine to form a finished paper or tissue product having enhanced quality due to the retention of at least said first and second adsorbable chemical additives on said fibers.

32. A fiber slurry produced using the method described in claim 31, wherein the amount of said first chemical additive adsorbed onto said pulp fibers is about 0.1 kilogram per metric ton or greater, and the amount of unadsorbed said first chemical additive in said water is between 0 and about 90 percent of the amount of said first chemical additive added to said pulp fibers.

33. A fiber slurry produced using the method described in claim 31, wherein the amount of said second chemical additive adsorbed onto said pulp fibers is about 0.1 kilogram per metric ton or greater, and the amount of unadsorbed said second chemical additive in said water is between 0 and about 90 percent of the amount of said second chemical additive adsorbed onto said pulp fibers.

34. A fiber slurry produced using the method described in claim 31, wherein the amount of said first chemical additive adsorbed onto said pulp fibers is about 0.1 kilograms per metric ton or greater, and the amount of unadsorbed said first chemical additive in said water is between 0 and about 90 percent of the amount of said first chemical additive added to said pulp fibers and wherein the amount of said second chemical additive adsorbed onto said pulp fibers is about 0.1 kilogram per metric ton or greater, and the amount of unadsorbed said second chemical additive in said water is between 0 and about 90 percent of the amount of said second chemical additive adsorbed onto said pulp fibers.

35. The fiber slurry of claim 32, 33, or 34, wherein the amount of said first chemical additive added to said pulp fibers is about 1 kilogram per metric ton or greater.

36. The fiber slurry of claim 32, 33, or 34, wherein the amount of said second chemical additive added to said pulp fibers is about 1 kilogram per metric ton or greater.

37. The fiber slurry of claim 32, 33, or 34, wherein the amount of said first chemical additive added to said pulp fibers is about 3 kilograms per metric ton or greater.

38. The fiber slurry of claim 32, 33, or 34, wherein the amount of said second chemical additive added to said pulp fibers is about 3 kilograms per metric ton or greater.

39. The fiber slurry of claim 32, 33, or 34, wherein the amount of said first chemical additive added to said pulp fibers is about 5 kilograms per metric ton or greater.

40. The fiber slurry of claim 32, 33, or 34, wherein the amount of said second chemical additive added to said pulp fibers is about 5 kilograms per metric ton or greater.

41. The fiber slurry of claim 32, 33, or 34, wherein said second chemical additive is selected from the group comprising softening agents, debonding agents, dry strength agents, wet strength agents and opacifying agents.

42. A paper or tissue product made from said fiber slurry of claim 32, 33, or 34.

43. A paper or tissue product made using the method of claim 31.

44. A method for preparing pulp comprising:

a) creating a fiber slurry comprising water, pulp fibers that have never been dried and an adsorbable chemical additive wherein said adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols; and, b) transporting said fiber slurry having said adsorbable chemical additive to a web-forming apparatus and forming a wet fibrous web, thereby forming a wet fibrous web having from between about 10 to about 100 percent retention of said adsorbable chemical additive.

45. A method for adding an adsorbable chemical additive to pulp, said method comprising:

a) mixing pulp fibers that have never been dried with water to form a fiber slurry;

b) adding an adsorbable chemical additive to said fiber slurry wherein said adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols;

c) transporting said fiber slurry having said adsorbable chemical additive to a web-forming apparatus and forming a wet fibrous web;

d) transporting said wet fibrous web to a paper machine and mixing said wet fibrous web with water to form a wet slurry, said wet slurry containing fibers having said adsorbable chemical additive adhered thereto; and, e) transporting said wet slurry through said paper machine to form a finished paper or tissue product having enhanced quality due to the retention of said adsorbable chemical additive on said fibers.

46. A method for adding an adsorbable chemical additive to pulp, said method comprising:

a) mixing pulp fibers that have never been dried with water to form a fiber slurry;

b) adding an adsorbable chemical additive to said fiber slurry wherein said adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols;

c) transporting said fiber slurry having said adsorbable chemical additive to a web-forming apparatus and forming a crumb pulp;

d) transporting said crumb pulp to a paper machine and mixing said crumb pulp with water to form a wet slurry, said wet slurry containing fibers having said adsorbable chemical additive adhered thereto; and, e) transporting said wet slurry through said paper machine to form a finished paper or tissue product having enhanced quality due to the retention of said adsorbable chemical additive on said fibers.

47. A method for adding an adsorbable chemical to pulp, said method comprising:

a) creating a fiber slurry comprising water, pulp fibers that have never been dried and at least a first adsorbable chemical additive wherein said first adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols; and a second adsorbable chemical additive; and, b) transporting said fiber slurry having at least said first and second adsorbable chemical additives to a web-forming apparatus and forming a wet fibrous web, thereby forming a wet fibrous web having from between about 10 to about 100 percent retention of at least said first and second adsorbable chemical additives.

48. A method for adding an adsorbable chemical to pulp, said method comprising:

a) mixing pulp fibers that have never been dried with water to form a fiber slurry;

b) adding a first adsorbable chemical additive to said fiber slurry wherein said first adsorbable chemical additive is a softening agent selected from the group consisting of quaternary ammonium compounds, quaternized protein compounds, phospholipids, silicone quaternaries, quaternized hydrolyzed wheat protein/dimethicone phosphocopolyol, copolymer, organoreactive polysiloxanes, and silicone glycols;

c) adding at least a second adsorbable chemical additive to said fiber slurry;

d) transporting said fiber slurry having at least said first and second adsorbable chemical additives to a web-forming apparatus thereby forming a wet fibrous web having from between about 10 to about 100 percent retention of at least said first and second adsorbable chemical additives;

e) transporting said wet fibrous web to a paper machine and mixing said wet fibrous web with water to form a wet slurry, said wet slurry containing fibers having at least said first an and second adsorbable chemical additives adhered thereto; and, f) transporting said wet slurry through said paper machine to form a finished paper or tissue product having enhanced quality due to the retention of at least said first and second adsorbable chemical additives on said fibers.

* * * * *